United States Patent [19]

Elliott

[11] Patent Number: 4,784,759

[45] Date of Patent: Nov. 15, 1988

[54] MAGNETIC SEPARATION MACHINE

[76] Inventor: Eldon G. Elliott, 7397 Kingsbridge, Canton, Mich. 48187

[21] Appl. No.: 26,661

[22] Filed: Mar. 17, 1987

[51] Int. Cl.[4] ..... B03C 1/14

[52] U.S. Cl. ..... 209/223.1; 209/223.2; 209/224

[58] Field of Search ..... 209/219, 223.1, 223.2, 209/227, 231, 232, 213, 224; 198/619

[56] References Cited

U.S. PATENT DOCUMENTS

| | | | |
|---|---|---|---|
| 1,605,117 | 11/1926 | Koizumi | 209/223.2 |
| 3,452,865 | 7/1969 | Eckhardt | 209/223.1 |
| 3,608,718 | 9/1971 | Aubrey | 209/223.1 |
| 3,658,178 | 4/1972 | Parnell | 209/223.1 |
| 3,759,367 | 9/1973 | Elliott | 198/619 |
| 4,042,492 | 8/1977 | Decker et al. | 209/223.1 |
| 4,054,513 | 10/1977 | Windle | 209/223.1 |
| 4,062,443 | 12/1977 | Wallace et al. | 209/227 |

*Primary Examiner*—Sherman D. Basinger
*Assistant Examiner*—Stephen P. Avila
*Attorney, Agent, or Firm*—Reising, Ethington, Barnard, Perry & Milton

[57] ABSTRACT

An apparatus (10,10') for handling articles by magnetic attraction includes a cylindrical casing (12,12') of non-magnetic material having upper (22,22') and lower (24,24') ports. A rotatable helix (32,32') is disposed within the casing (12,12') between the ports (22,22',24,24'). Magnetic elements (42,42') are disposed outside of the casing (12,12') for directing a magnetic field through the casing (12,12') and into the casing as the ramp (32,32') rotates. The magnetic field extends along the length of the helical ramp (32,32').

8 Claims, 2 Drawing Sheets

MAGNETIC SEPARATION MACHINE

FIELD OF THE INVENTION

The invention relates generally to article handling apparatus and is particularly concerned with magnetic article sorting, parts handling, and/or parts storage apparatus and systems.

DESCRIPTION OF RELATED ART

In many industrial processes, it is necessary to separate ferrous or magnetically attractive material, from nonmagnetic material. Under certain conditions, it is necessary to separate ferrous metal fines and powders. These fines and powders can be dry and separated from other dry powders. Alternatively, the metal fines and powders can be wet and separated from a liquid.

Material handling problems have been associated with the powdered metal industry and steel shot manufacturers with regard to dry materials as well as the metal grinding equipment industry wherein it is necessary to remove ferrous fine material from a liquid.

Problems with prior art assemblies are that they include multiple parts and are incapable of handling large capacity separations. Prior art assemblies also have problems with being adapted to both elevate and lower collected ferrous material. Further, metering of discharged materials must be accomplished because the assembly is one part of an entire material handling system requiring a metered feed of the ferrous material. Finally, excess liquid from collected material must be discharged. In metal grinding equipment systems. It is preferable to return the clean liquid back to the coolant-/oil system for reuse.

Examples of prior art assemblees which sort magnetic materials are the U.S. Pat. Nos. 3,759,367 to Elliott, issued Sept. 18, 1973; 4,062,443 to Wallace, issued Dec. 13, 1977; and 1,605,117 to Koizumi, issued Nov. 2, 1926.

The present invention may be adapted to be an elevator/lowerator or a collection/separation machine and provides a solution to each of the above mentioned problems of the prior art.

SUMMARY OF THE INVENTION

The present invention provides an apparatus for handling articles by magnetic attraction. The apparatus includes elongated, hollow, cylindrical casing of nonmagnetic material. The casing has upper and lower ports and continuous uninterrupted outer and inner surfaces extending therebetween. A helical ramp is rotatably disposed within the casing between the upper and lower ports and includes an outer edge adjacent to the inner surface of the casing. The ramp and inner surface define a spiral passageway. Magnetic means are disposed outside of the casing for directing a magnetic field through the casing and into the passageway as the ramp rotates. The magnetic field extends along the length of the passageway.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
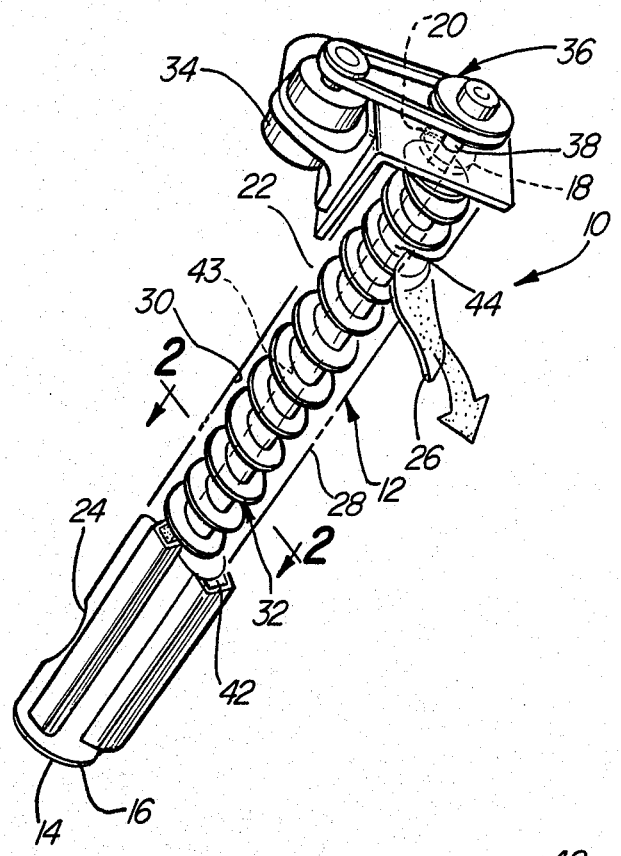
FIG. 1 is a perspective view partially broken away of a magnetic elevator/lowerator machine constructed in accordance with the present invention.
Figure 2:
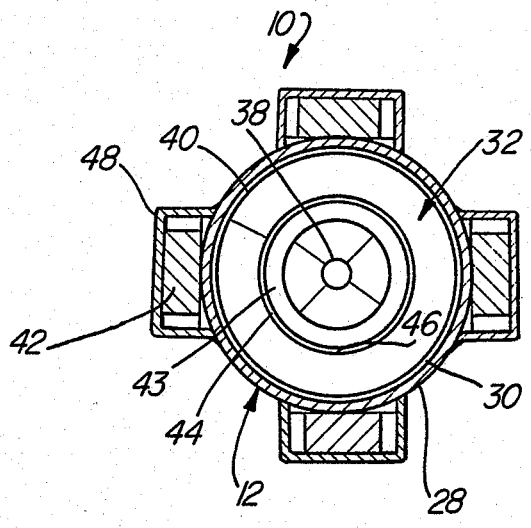
FIG. 2 is a cross sectional view taken substantially along lines 2—2 of FIG. 1.

An apparatus for handling articles by magnetic attraction is generally shown at 10 in FIGS. 1 and 2. Primed numbers are used to indicate like structure between the several embodiments disclosed.

Generally, the apparatus 10 includes an elongated hollow cylindrical casing generally indicated at 12. The casing 12 is a tube made from nonferrous, nonmagnetic material. The tube 12 is stationary and includes a bottom end plug 14 connected to the casing 12 by connecting screws 16. A top plug 18 is connected to the top of the casing 12 by connecting screws 20.

The casing 12 includes an upper port 22 and a lower port 24. The upper port 22 is a material inlet when the assembly is used as a lowerator and the lower port 24 is used as a material outlet. The lower port 24 is used as a material input and the upper port 22 is used as a material output when the assembly is used as a magnetic elevator. A discharge chute 26 is connected to the port used for discharge to guide the discharged material out from the casing 12. The casing 12 further includes a continuous uninterrupted outer surface 28 and an inner surface 30 extending between the upper and lower ports 22,24.

A helical ramp generally indicated at 32 is rotatably disposed within the casing 12 between the upper and lower ports 22,24. The helical ramp 32 is made from a nonferrous, nonmagnetic material. The helical ramp 32 is rotatable relative to the casing 12. A motor 34 is operatively connected through a pulley and belt system generally indicated at 36 to a driven rod 38. The driven rod 38 is operatively connected to the helical ramp 32 to rotate the helical ramp 32 in either a clockwise or counterclosckwise direction.

The helical ramp 32 includes an outer edge 40 adjacent to the inner surface 30 of the casing 12. The combination of the helical ramp 32 and the inner surface 30 of the casing 12 define a spiral passageway which extends along the length of the casing 12.

The apparatus 10 includes magnetic elements 42 disposed outside of the casing 12 for directing a magnetic field through the casing 12 and into the spiral passageway as the helical ramp 32 rotates. The magnetic field extends along the length of the passageway. The magnetic field can be supplied by permanent or electromagnetic elements.

The rotation of the helical ramp 32 collects and elevates ferrous material within the casing 12 and discharges the material through the upper port 22 on a metered basis. When the motor 34 is reversed, material fed through the upper port 22 is separated as it is lowered through the casing 12 and discharged at the lower port 24.

The metered discharge of the material is accomplished by the amount of material held to the inner surface 30 of the casing 12 by the magnetic elements 42 in relation to the RPM of the helical ramp 32. The elements in combination meter the discharge of the material elevated or lowered by the rotating helix.

The embodiment in FIG. 1 is used to elevate or lower fines and powders which are dry. The assembly includes a nonferrous, nonmagnetic cylinder 43 defining an inner wall 44 of the spiral passageway. The inner wall 44 is radially spaced inwardly and concentrically from the inner surface 30 of the casing 12. The tube 43 extends the length of the helical ramp 32 through the center of the ramp 32. The helical ramp 32 has an inner edge 46 adjacent ot the inner wall 44.

The discharge of material in the embodiment shown in FIGS. 1 and 2 is also metered by the outer diameter of the nonmagnetic tube 43. This nonmagnetic tube 43 is welded to the inner diameter or inner edge 46 of the helical ramp 32. This controlled space between the tubes 12 and 43 at which ever port 22,24 is used for discharge physically forces collected ferrous material out of the magnetic field and onto the discharge ramp 26 for discharge. The embodiment shown operates in a substantially vertical position for use with dry ferrous fines and powders. The device can be operated at any angle, horizontal to vertical.

The apparatus 10 includes magnetic housings 48 extending along the length of the casing 12. The magnetic elements 42 are disposed within the magnet housings 48.

Figure 3:
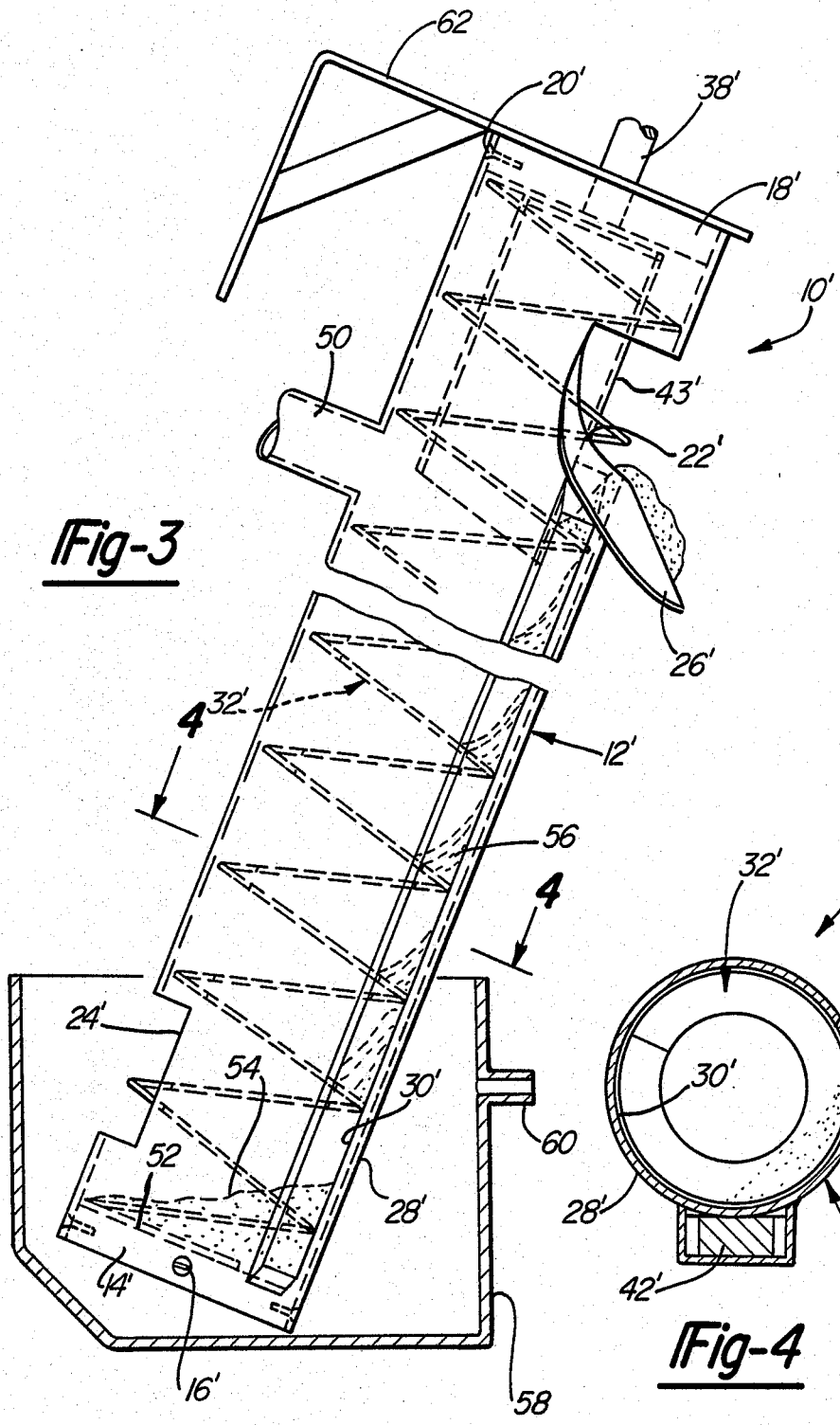
FIG. 3 is a cross sectional elevational view of a second embodiment of the present invention.
Figure 4:
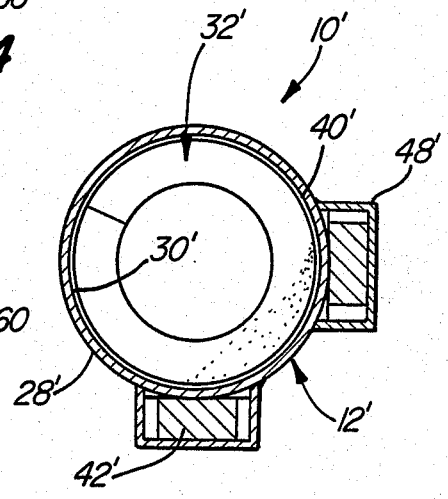
FIG. 4 is a cross sectional view taken substantially along lines 4—4 of FIG. 3.

A second embodiment 10' of the invention is shown in FIGS. 3 and 4. This embodiment can be used as a separation unit for collecting ferrous fines from a liquid carrier. The device 10' is designed to operate at any angle, horizontal to vertical. The apparatus 10' includes a casing 12' having a fluid inlet 50 disposed below the upper port 22'. The fluid inlet 50 is in fluid communication with the internal passageway defined by the helical ramp 32' and inner surface 30' of the casing 12'. The lower port 24' providss a fluid outlet.

The lower plug 14' provides an inner bottom wall 52. The fluid outlet 24' is spaced above the bottom wall 52. The housing below the outlet 24' defines a substantially cup shaped waste trap below the fluid outlet 24' wherein waste material 54 which is separated from the ferrous material 56 is contained.

The nonmagnetic tube element 43' extends only partially down through the helical ramp 32'. Below the fluid inlet 50, the helical ramp 32' is open through its middle, as shown in FIG. 4. The opening through the center of the helical ramp 32' allows movement of liquid through the device 10' while magnetic attraction collects ferrous fines to the inner surface 30' of the stationary casing 12'. The casing 12' is disposed within a fluid trap 58 having a clean liquid discharge port 60.

The casing 12' is supported by a frame work 62 which also supports a drive assembly as previously described with relation to the embodiment shown in FIG. 1. The drive assembly is operatively connected to the driven rod 38' which is in turn is operatively connected to the nonmagnetic tube 43'. Nonmagnetic tube 43' is welded to the inner diameter of the helical ramp 32', the tube 43' extending to a point above or at the fluid inlet 50.

In operation, ferrous laden liquid enters through the fluid opening 50. The ferrous material is attracted to the inner surface 30' of the casing 12' by the magnetic field directed by the magnets 42'. The nonmagnetic particles are trapped and collected by the rotating helical ramp 32', with the magnetic particles. Thus, both magnetic and nonmagnetic particles are collected for discharge. The clean fluid leaves through opening 24' into the fluid trap 58 and then is transported back to the system through fluid outlet 60.

Both embodiments of the present invention includes a single moving part. Although the assembly is small in size, it is large in capacity and is controlled by the RPM of the rotating helcial ramp 32,32'. The assemblies can be used to elevate as well as lower collected ferrous material. There is metered discharge of the collected materials, the metered discharge being accomplished by the amount of material held to the inner surface 30,30' of the casing 12,12' by the magnetic elements 42,42' in relation to the RPM that the internal helixes turn. Finally, the embodiment shown in FIGS. 3 and 4 drains excess liquid from collected material before discharge and returns clean liquid back to the metal grinding equipment.

The invention has been described in an illustrative manner, and it is to be understood that the terminology which has been used is intended to be in the nature of words of description rather than of limitation.

While specific embodiments of the invention have been illustrated in the accompanying drawings and described in the foregoing specification, it should be understood that the invention is not limited to the specific construction shown. Alternatives in the construction and arrangement of parts, all falling within the scope and spirit of the invention, will be apparent to those skilled in the art.

What is claimed is:

1. An apparatus (10,10') for handling articles by magnetic attraction comprising; an elongated, hollow, cylindrical outer casing (12,12') of nonmagnetic material, said casing (12,12') having upper (22,22') and lower (24,24') ports and continuous, uninterrupted outer (28,28') and inner (30,30') surfaces extending therebetween; a helical ramp (32,32') of nonferrous, nonmagnetic material rotatably disposed within said casing (12,12') between said upper (22,22') and lower (24,24') ports and including a continuous helical outer edge (40,40') constantly adjacent to said inner surface (30,30'), said ramp (32,32') and inner surface (30,30') defining a spiral passageway; and magnet means (42,42') disposed outside of said casing (12,12') for directing a magnetic field through and into said passageway casing (12,12') and into said passageway as said ramp (32,32') rotates, said magnetic field extending continuously along the length of said passageway.

2. An apparatus as set forth in claim 1 further characterized by including a cylindrical inner wall (44) spaced radially inwardly and concentrically from said inner surface (30), said ramp (32) having an inner edge (46) adjacent to said inner wall (44).

3. An apparatus as set forth in claim 1 wherein said magnetizing means includes a plurality of magnets (42,42') extending along the length of said casing (12,12').

4. An apparatus as set forth in claim 3 including a plurality of magnet housings (48,48') extending along the length of said casing (12,12'), said magnets (42,42') being disposed within said magnet housings (48,48').

5. An apparatus as set forth in claim 4 including an outlet (26,26') extending from said upper port (22,22') outside of said magnetic field, said lower port (24,24') defining a material inlet.

6. An apparatus as set forth in claim 1 wherein said casing (12') includes a fluid inlet (50) below said upper port (22') and in fluid communication with said passageway, said lower port (24') defining a fluid outlet.

7. An apparatus as set forth in claim 6 wherein said casing (12') includes a bottom wall (52), said fluid outlet (24') being spaced above said bottom wall (52) and said casing (12') defining a substantially cup shaped waste trap therebetween.

8. An apparatus as set forth in claim 1 wherein said magnetizing means includes four bar magnets (42), each of said bar magnets (42) extending along the length of said casing (12) between said upper (22) and lower (24) ports, said magnets (42) being equally spaced about said casing (12).

* * * * *